US005568013A

United States Patent [19]

Then et al.

[11] Patent Number: 5,568,013

[45] Date of Patent: Oct. 22, 1996

[54] MICRO-FABRICATED ELECTRON MULTIPLIERS

[75] Inventors: Alan M. Then, Auburn, Mass.; Gregory L. Snider, South Bend, Ind.; Robert J. Soave, Cortland, N.Y.; G. William Tasker, West Brookfield, Mass.

[73] Assignee: Center for Advanced Fiberoptic Applications, Southbridge, Mass.

[21] Appl. No.: 282,004

[22] Filed: Jul. 29, 1994

[51] Int. Cl.[6] ..... H01J 43/04

[52] U.S. Cl. ..... 313/532; 313/103 R; 313/103 CM

[58] Field of Search ..... 313/103 R, 103 CM, 313/105 CM, 528, 532, 534, 533

[56] References Cited

U.S. PATENT DOCUMENTS 3,244,922 4/1966 Wolfgang .

4,025,813 5/1977 Eschard et al. ..... 313/105 CM 4,095,132 6/1978 Fraioli .

4,757,229 7/1988 Schmidt et al. .

5,086,248 2/1992 Horton et al. .

FOREIGN PATENT DOCUMENTS 1121858 4/1982 Canada .

*Primary Examiner*—Sandra L. O'Shea

*Assistant Examiner*—Vip Patel

*Attorney, Agent, or Firm*—Watson Cole Stevens Davis, P.L.L.C.

[57] ABSTRACT

A micromachined electron multiplier is disclosed wherein a substrate has at least one trench formed therein and an aperture cover is disposed on the substrate with at least one inlet aperture aligned with one end of the channel. Either the substrate or the apertured cover may have an outlet aperture formed therein. A variety of channel shapes, and arrays are disclosed as well as a solid state photomultiplier tube formed with an integrated radiation window and anode structure.

33 Claims, 10 Drawing Sheets

FIG. 7.
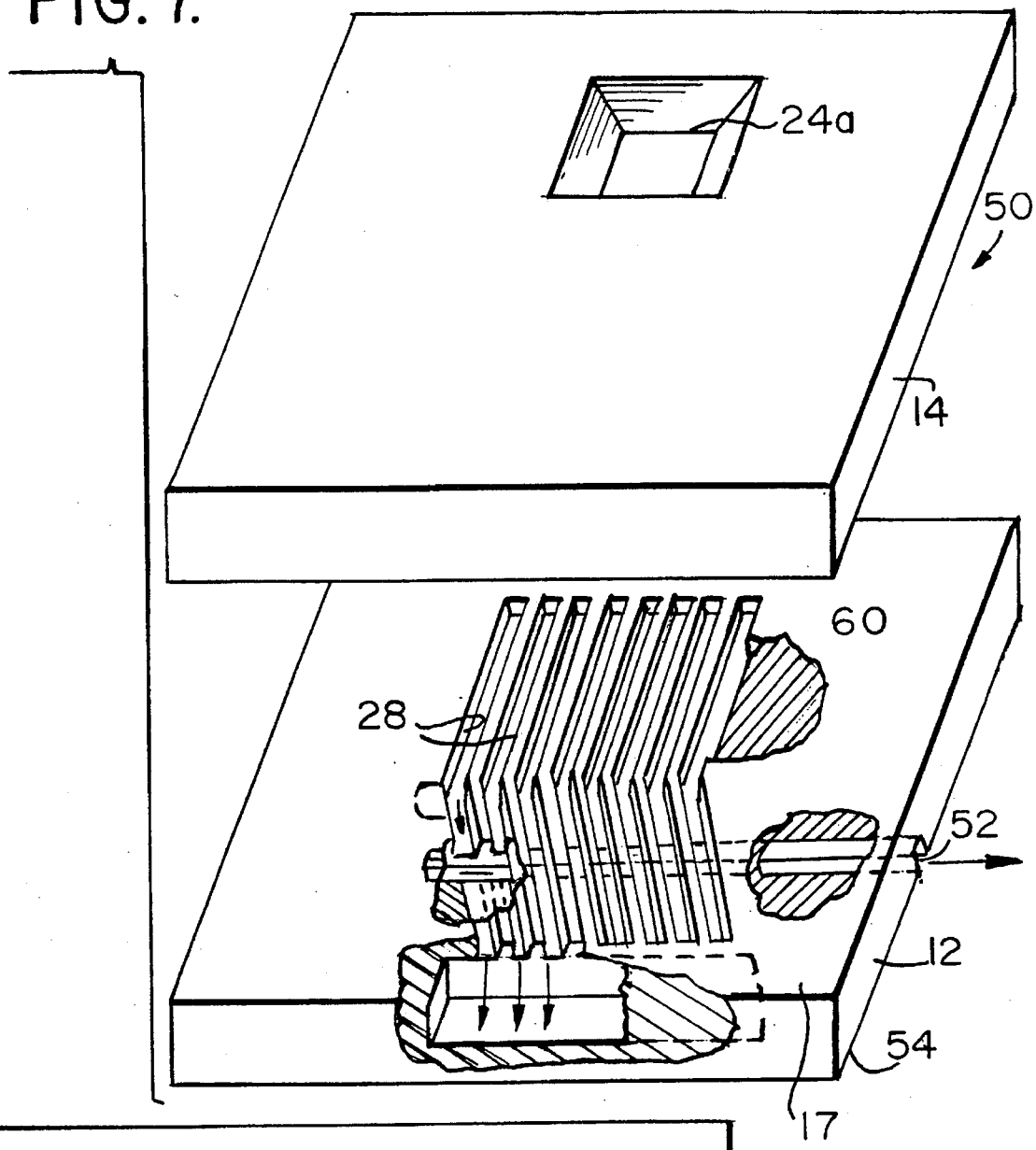
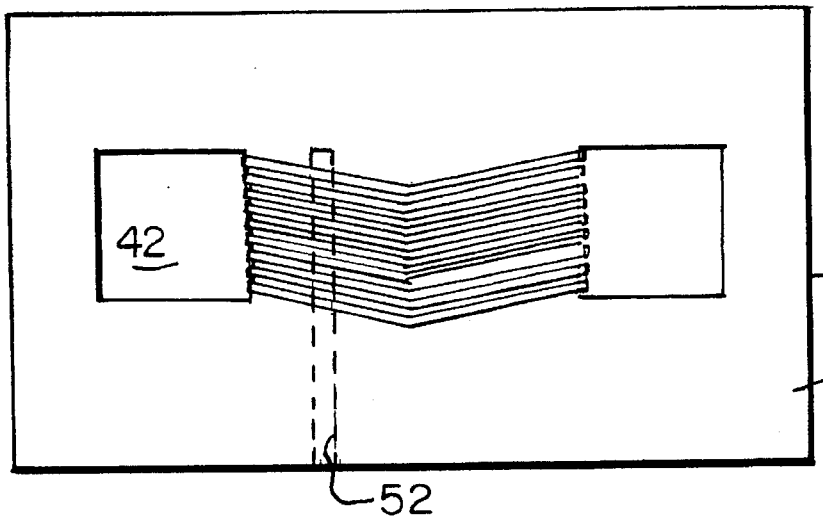
FIG. 8.

MICRO-FABRICATED ELECTRON MULTIPLIERS

GOVERNMENT RIGHTS

The invention was made with the support of the United States Government under Contract No. NIST70NANB3H1371, awarded by National Institute of Standards and Technology (NIST). The Government has certain rights in this invention.

BACKGROUND OF THE INVENTION

The invention pertains to electron multipliers and in particular, relates to electron multipliers having one or more micromachined channels and thin-film activation.

Conventional microchannel plate (MCP) manufacture relies on the glass multifiber draw process in which individual composite fibers consisting of selectively etchable core glass and a cladding glass are formed by draw down of a rod-and-tube preform. The multifiber bundles are stacked together and fused within a glass envelope to form a solid billet. The billet is then sliced, typically at a angle, with respect to the billet axis. The resulting wafers are polished and the soluble core glass is removed by a suitable chemical etchant to produce a wafer containing an array of microscopic channels. Further chemical treatments, followed by a hydrogen reduction process, produces a thin wafer of glass containing an array of hollow channels with continuous dynodes of reduced lead silicate glass having conductive and emissive properties required for electron multiplication.

The glass multifiber draw process, while commercially satisfactory and economical, suffers from a disadvantage that the size of the individual channels is governed at least in part by multiple glass drawing steps. Variations in fiber diameter can cause different signal gains within a microchannel plate and from one device to another. Another disadvantage is that the current technology allows for some irregularity in the array when multifibers are stacked and pressed to form the billet. Thus, there is no long-range order in channel location, and channel geometry is not usually constant across the array. There are other manufacturing difficulties involved in the various steps necessary to complete the device, a discussion of which may be found in U.S. Pat. No. 5,086,248, entitled Microchannel Electron Multipliers, by Horton et al., assigned to the assignee herein, the teachings of which are incorporated herein by reference.

Conventional fabrication of a channel electron multiplier (CEM) is simpler; it involves thermal working of lead silicate glass tubing into a curved or spiral geometry and reducing the glass surface in hydrogen to produce a continuous thin film dynode. Alternatively, an array of glass tubes can be bundled together and thermally worked into a helical configuration before activation of the channel walls by hydrogen reduction to form a multichannel device. Such manufacturing methods are labor intensive, and thus expensive, and can produce mechanical variability in the channel geometry which can affect electrical performance.

Attempts have been made to crystalize photosensitive glass in a lithographically defined pattern to render the crystallized region selectively etchable from the glass, leaving behind an array of channels for producing a microchannel plate. However, only moderate etch selectivity has been achieved and nonparallel sidewalls can result, limiting minimum channel spacing. Attempts have also been made to selectively wet etch a silicon wafer, however, simple holes with vertical sidewalls extending through the wafer cannot be achieved due to known crystallographic constraints.

Other approaches to the manufacture of the CEMs include the machining or molding of a ceramic substrate and activation with a reduced lead silicate glass or other thin film dynode (Carette and Bouchard Canadian Patent No. 1,121,858; Wolfgand U.S. Pat. No. 3,244,922; Fraioli U.S. Pat. No. 4,095,132; Schmidt and Knak U.S. Pat. No. 4,757,229). Fabrication of suitable ceramic substrates enclosing a curved or spiral channel is difficult and expensive.

In Horton et al. referred to above and Tasker et al., U.S. Ser. No. 08/089,771, entitled Thin-Film Continuous Dynode for Electron Multiplication, filed Jul. 12, 1993, and assigned to the assignee herein, the teachings of which are incorporated herein by reference, methods for selectively etching advanced technology microchannel plates and channel electron multipliers by use of a directionally applied flux of reactive particles along with the activation with thin-film dynodes is discussed. The present invention evolved from the need for structures to test dynodes for these advanced technology microchannel and channel electron multipliers formed by anisotropic directional etching and activated by thin-film techniques.

The disclosure herein describes micromachined electron multipliers of lower cost and greater ease of manufacture for detection of charged particles and energetic photons and a particular application for such devices in a photomultiplier tube. All of the illustrations are representative of the structure and arrangement and are not drawn to scale.

SUMMARY OF THE INVENTION

The invention is based upon the discovery that a micromachined electron multiplier (EM) can be formed with at least one trench-like channel formed in a substrate. An apertured channel cover disposed on the substrate and bonded thereto has an input aperture formed therein which is located for registration with one of the ends of the trench. In addition, the channel cover may have another aperture located at the opposite end of the channel, or the substrate may be formed with an aperture on a side opposite the trench to form an output aperture. A thin-film dynode formed on the channel wall incorporates an electron emissive layer overlying a current carrying layer overlying an isolation layer for electrically isolating the dynode from the substrate.

The invention is also directed to an application for a photomultiplier tube, wherein an electron multiplier is sandwiched between a multilayer photocathode component, comprising a transparent window and electrode and a photocathode disposed over the input aperture, and an anode component, comprising a support and an anode electrode disposed opposite the output aperture. Various layers are bonded together to form an evacuated structure. A getter element may also be employed to maintain the vacuum.

BRIEF DESCRIPTION OF THE DRAWINGS

FIG. 7 is an exploded perspective showing the aperture component and trench component of another embodiment of an electron multiplier according to the invention;

FIG. 8 is a bottom view of the trench component illustrated in FIG. 7;

DESCRIPTION OF THE INVENTION

The present invention is a completely micromachined electron multiplier (EM) that is activated with thin-film dynodes. In an exemplary embodiment, the device is fabricated in a two-step process employing microstructure construction and thin-film activation.

Figure 1:
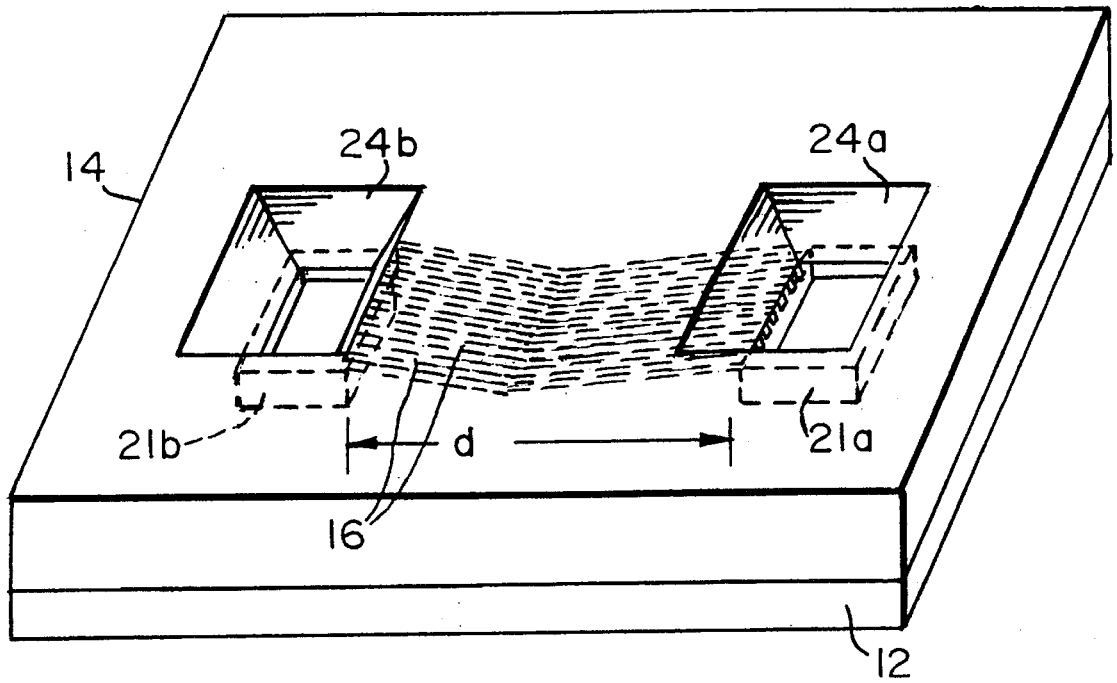
FIG. 1 is a fragmentary prospective view of an electron multiplier according to the present invention.
Figure 1A:
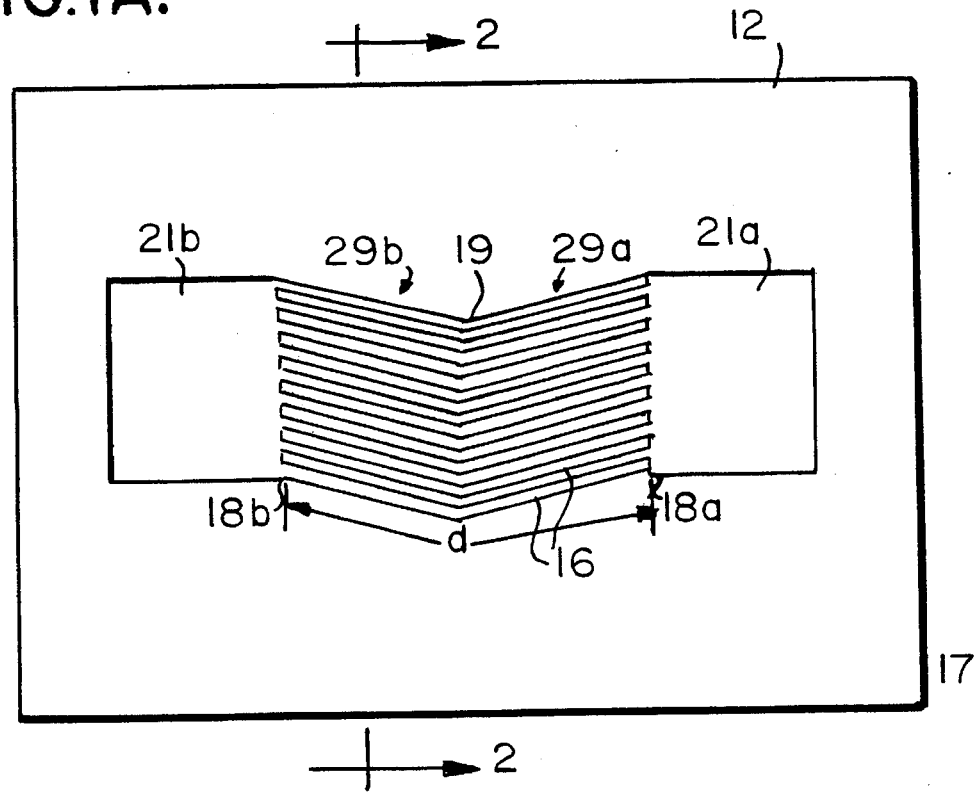
FIGS. 1A and 2 respectively illustrate a top view and a cross-sectional view of a trench component forming one embodiment of an electron multiplier according to the present invention.
Figure 2:
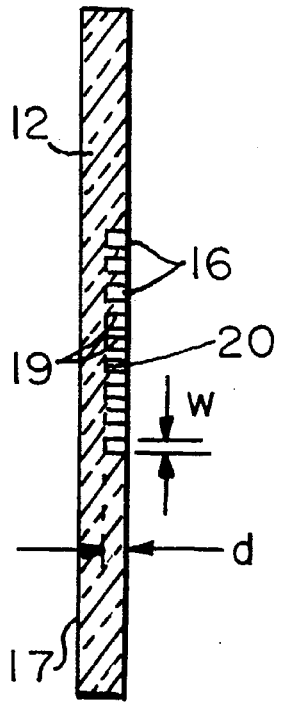

An exemplary embodiment of an electron multiplier 10 according to the present invention is illustrated in FIGS. 1–5. The electron multiplier 10 comprises a trench component 12 (FIG. 1A), an aperture component 14 (FIG. 3) and electrodes, hereinafter described. The trench component 12 is fabricated by anisotropically dry etching a series of nominally square cross-sectioned trenches 16 of length l and width w and depth d into the face of a highly polished, suitably masked (not shown) silicon (Si) wafer 17 (FIGS. 1, 1A and 2). The trenches 16 have end portions 18A and 18B, upstanding wall separating portions 19 and bottom wall portions 20. Also, if desired, recesses 21A and 21B may be etched in the wafer 18 near the corresponding ends 18A, 18B.

Figure 4:
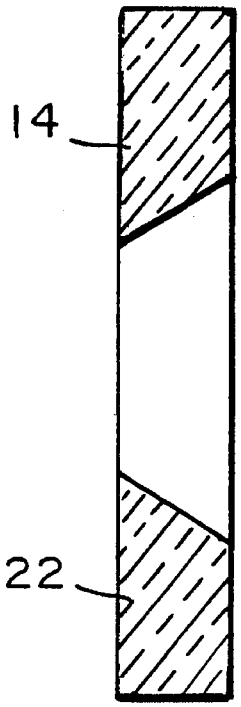
FIGS. 3 and 4 respectively illustrate a top view and side sectional view of an aperture component of an electron multiplier according to one embodiment of the present invention.
Figure 3:
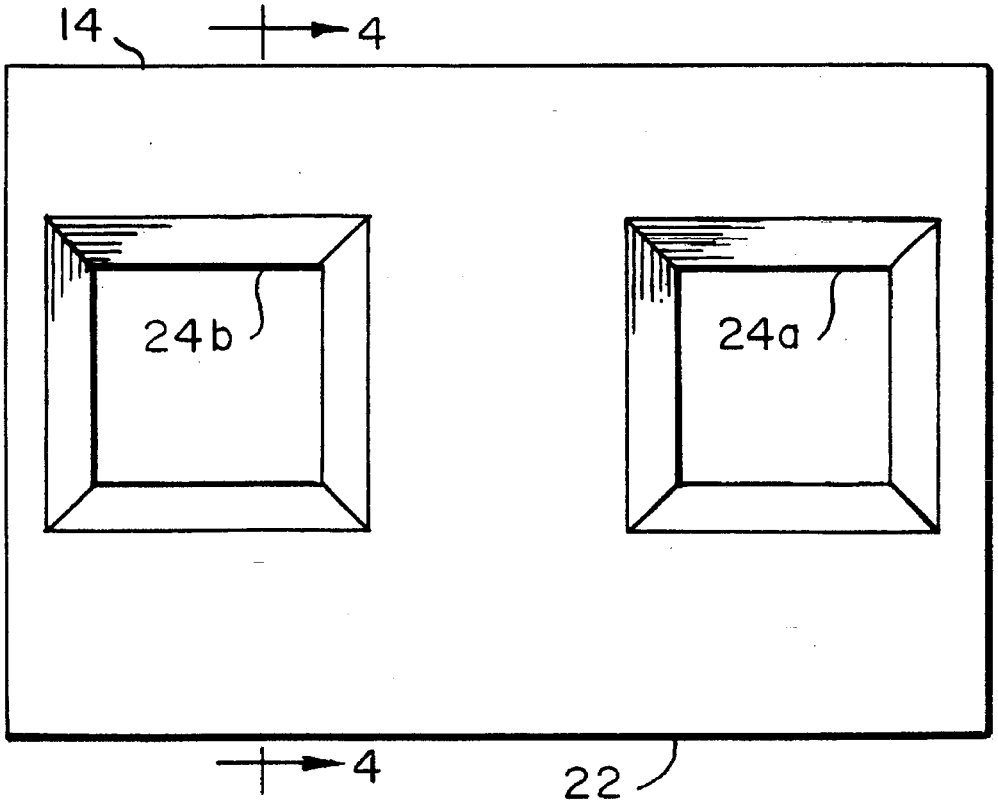
Figure 5:
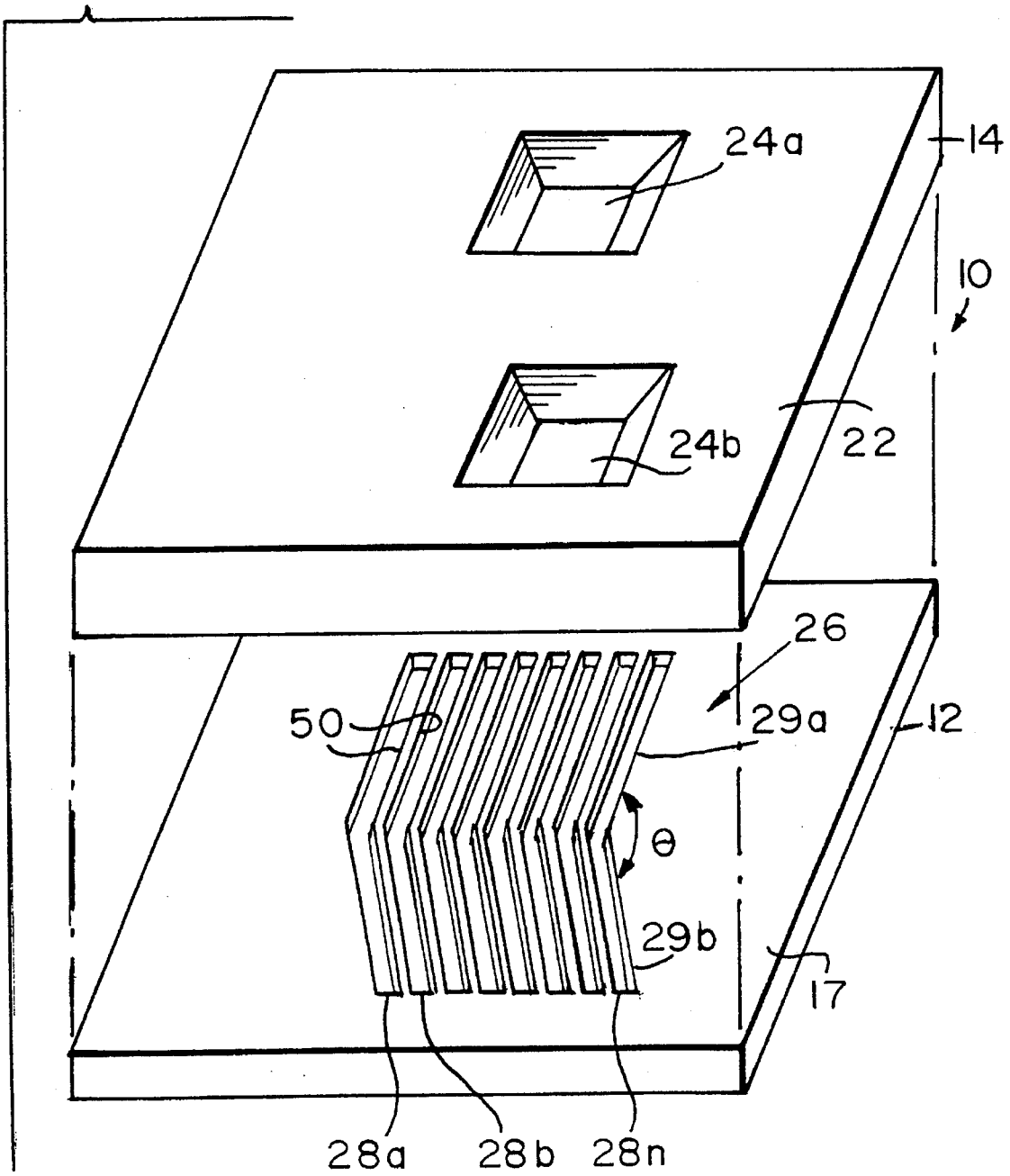
FIG. 5 is an exploded perspective view of the trench and aperture components illustrated in FIGS. 1–4, with the inlet portion not shown for simplicity.

The trench component 12 is subsequently bonded at elevated temperatures to a second Si wafer 22 forming the aperture component 14, through which pyramidal apertures 24A, 24B have been anisotropically wet etched by suitable masking of a (100) Si face of the wafer 22 (FIGS. 3 and 4). The apertures 24A and 24B are positioned in registration and communicate with the respective recesses 21A and 21B located at the ends 18A, 18B of the trenches 16. A 1×N array 26 of channels 28*a* . . . 28*n* is formed upon bonding the two components 12 and 14 (FIG. 5). Thermal bonding of two Si wafers requires the opposing surfaces of the two components be extremely flat, smooth and free of particles. In FIG. 5, the recesses 21A, 21B are not shown to simplify the drawing.

A plurality of arrays 26 may be formed in a single wafer 22 with a common apertured wafer 22. Once the wafer set is bonded, it may be diced to yield a number of individual multiplier substrates. In the exemplary embodiment, the channels 28 (letter designations a . . . n are not used for simplicity), created by the Si wafer bonding process, are in the form of a "V" shaped chevron having legs 29A, 29B with an angle θ of 120° to 160° therebetween. In the embodiment illustrated, d and w are the same forming a square cross-sectional trench. The channels 28 may also be curved or straight, if desired. In addition, straight channels 28 may have an aspect ratio length-to-width l/d in a range of about 10:1 and about 100:1. Curved channels (not shown in FIGS. 1–5 but see FIG. 12) may have length-to-radius l/r of curvature ratios in a range of about 1 and about 6. Serpentine channels 74S (FIG. 12A) can have even higher l/r ratios. The trenches and apertures may be formed by a number of techniques including: isotropic wet and dry etching, single point diamond machining, laser assisted chemical etching and laser etching.

A variety of trench and aperture configurations are available depending on the application. Trench cross-sections need not be square and sizes can vary from as small as ~4 μm to as large as ~1000 μm. Apertures could also be scaled from several microns to several millimeters. Structures including multiple apertures and multiple trenches may also be constructed to serve as multi-point detectors or as an imaging detector.

Figure 6:
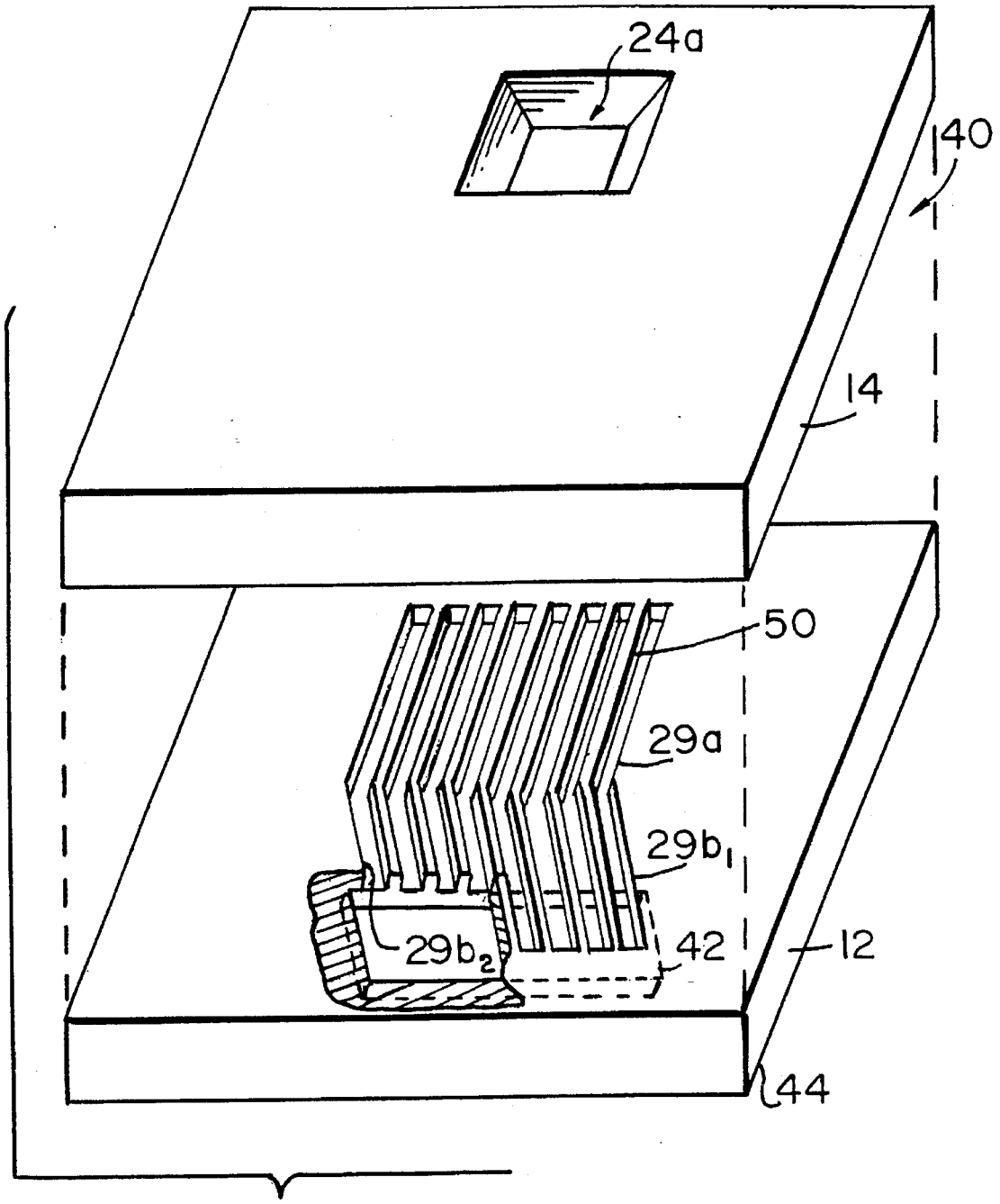
FIG. 6 is an exploded perspective view of an aperture component and trench component according to another embodiment of the present invention.

Another embodiment of an electron multiplier 40, according to the invention, is shown in FIG. 6, wherein similar reference numerals are employed for the same components. The electron multiplier 40 includes a more complex structure incorporating a second processing sequence to the trench component 12. This process, similar to that used in constructing the aperture component 14, is used to produce an aperture 42 exiting the back-side 44 of the multiplier substrate 17. This opening 42 acts as the output on the back-side of the device.

In another embodiment shown in FIG. 7, an electron multiplier 50 has one or more additional trenches 52 etched at desired intervals into the back 54 of the trench component 12 to allow electrical access to the channels 28 for creation of multi-stage devices such as described in U.S. patent application Ser. No. 08/222,811, filed Apr. 5, 1994, by Anthony Bauco and Alan Then, and assigned to the assignee herein, the teachings of which are incorporated by reference.

Figure 9:
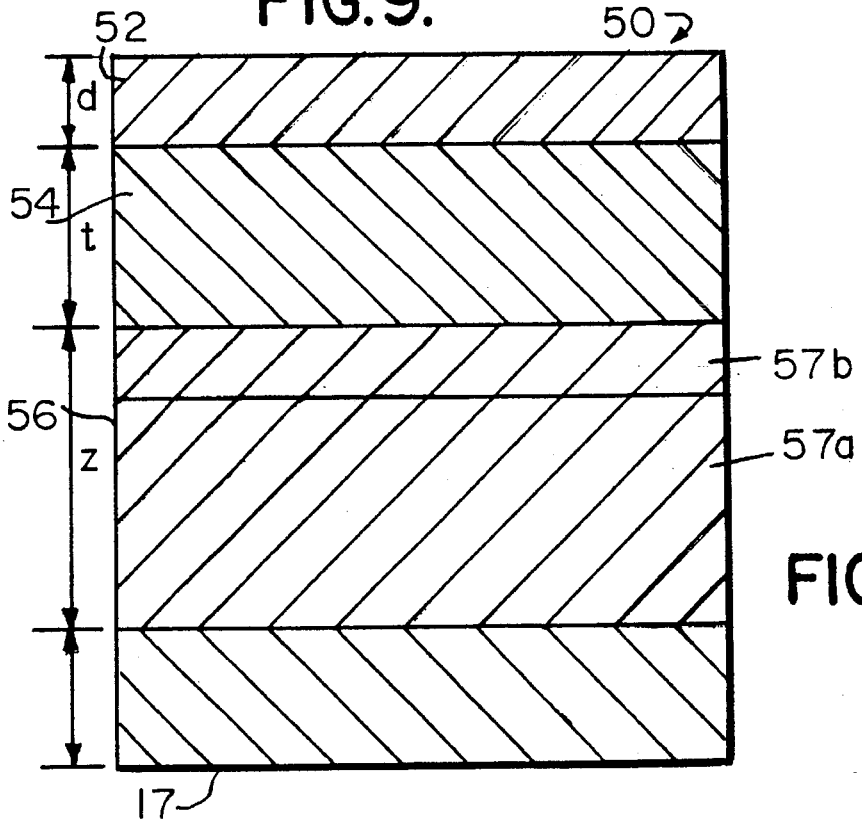
FIG. 9 is a side-sectional elevation of a dynode structure for a conductive substrate and isolation layer in accordance with the present invention.

In the arrangements illustrated in FIGS. 1–7, each channel 28 is activated with a thin-film dynode 50 formed on the various wall portions. The dynodes 50 shown in FIG. 9 are formed with an electron emissive portion 52 overlying an electrically conductive portion 54. The activation is necessary to render the channel walls within the structure capable of supporting avalanche electron multiplication. In the exemplary embodiments illustrated, the Si substrates forming wafers 17 and 22 are electrically conductive. Accordingly, the Si cannot support the electrical fields necessary for electron multiplication without experiencing severe joule heating and thermal runaway. It is thus necessary to electrically isolate the Si microstructure prior to deposition of respective conductive and emissive films 52 and 54. This may be accomplished in the embodiment illustrated by an isolation layer 56 disposed on the substrate layer 17.

The electrical isolation may be carried out by a high temperature thermal oxidation in a steam ambient at atmospheric pressure. After about 10 hours at 1100° C., a thermal oxidation layer 57A approximately 2 μm of $SiO_2$ 57A completely covers the Si microstructure. This process becomes diffusion limited and thicker layers of thermal oxide that are grown by this technique are not practical. However, thermal oxide layers in the range of approximately 2 μm to 5 μm can be produced by oxidation at elevated pressures. To augment this thermal oxide layer, an additional deposition of a dielectric thin-film 57B may be required. This may be accomplished by low-pressure chemical vapor deposition (LPCVD) in order to achieve uniform and conformal coverage inside the channels 28. A suitable dielectric film 57B is a so-called low stress silicon nitride ($Si_xN_y$).

Once isolated by the isolating film 56, the semiconductive film 54 of between 10 to 1000 nm is deposited, again by LPCVD. In the exemplary arrangement, the film B4 may be n-type amorphous Si doped with various concentrations of phosphorus (P) and oxygen (O) required to obtain a desired resistance for the device of between $(10)^6$ to $(10)^9$ Ohms. The addition of oxygen to the film 54 is critical for stabilizing the electrical properties during subsequent thermal processing. Without additions of O, the film 54 may crystallize during emissive layer depositions or thermal growth at higher temperatures (>580° C.) rendering the device unusable. Alternatively, As may be substituted for P and N may be substituted for O. It may be possible to use a p-type amorphous Si doped film 54, doped with such elements as boron (B) or aluminum (Al).

Once the semiconductive film 54 is deposited, an electron emissive film 52 is then formed inside the channel. Generally, this is accomplished by LPCVD of between 2 to 20 nm of such materials as $SiO_2$ or $Si_3N_4$, although $Al_2O_3$, AlN, C (diamond), or MgO would also serve as excellent candidates. Other methods for producing an electron emissive film 52 include atmospheric pressure chemical vapor deposition (APCVD) and surface modification by thermal oxidation or nitriding techniques. The overall continuous dynode structure 50 so formed is illustrated in FIG. 9.

Figure 10:
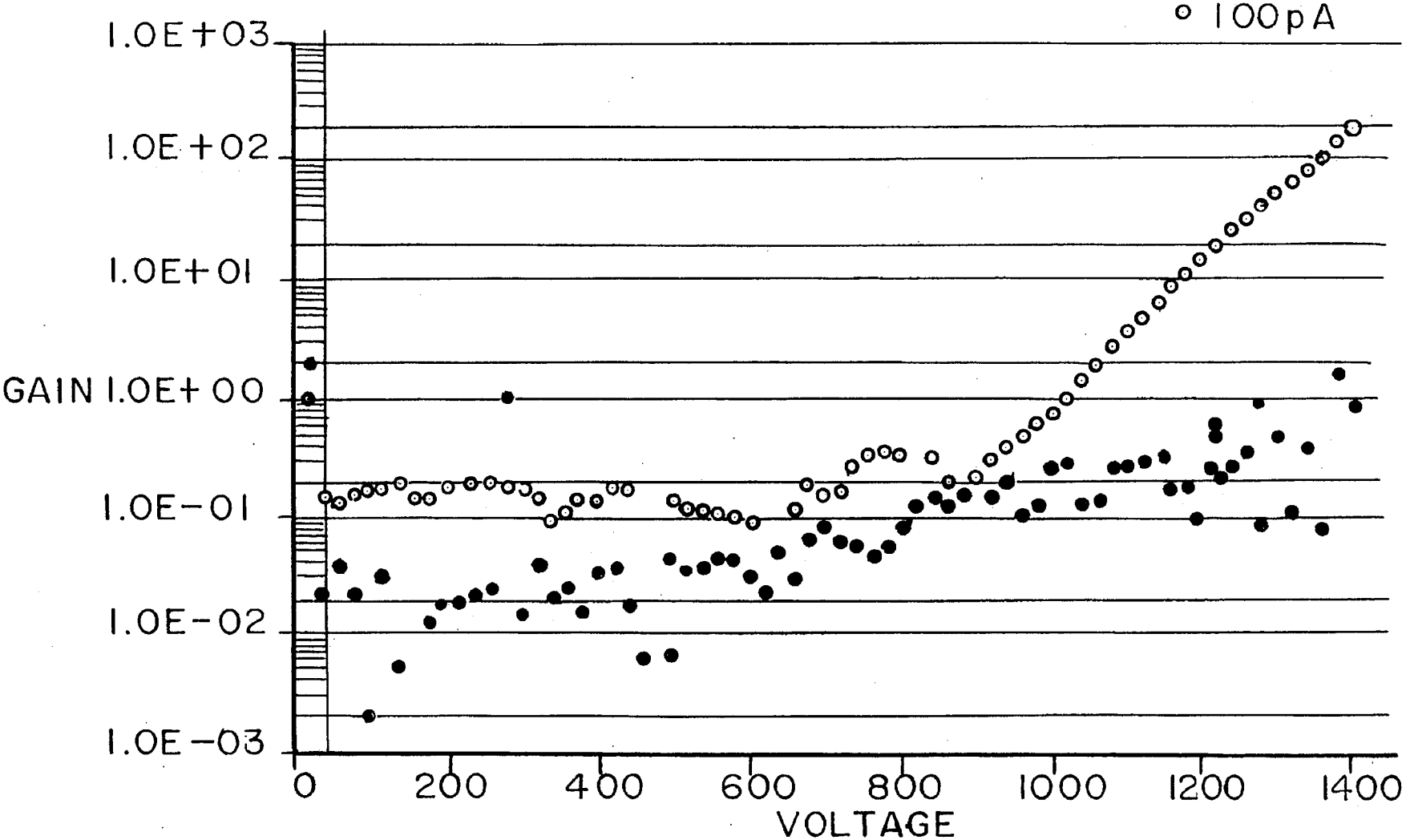
FIG. 10 is a plot of gain versus voltage for a micromachined electron multiplier according to one embodiment of the present invention.

A prototype device similar to that illustrated in FIG. 5, was successfully tested. The dynode structure, similar to that illustrated in FIG. 9, utilized a 2.2 micron thick thermal oxide in combination with a 0.8 micron thick low-stress LPCVD nitride for its isolation layer 56. A 200 nm thick LPCVD P-O-doped amorphous silicon film composed the conductive layer 54 and a 3.5 nm thick thermal $SiO_2$ film comprised the emissive layer 52. A plot of the gain of the device as a function of applied voltage is shown in FIG. 10. The gain of 200 was measured at an applied voltage of 1400 volts for a 1 KeV argon ion input of 100 pA.

The following Table sets forth parameters of the structure shown in FIG. 9.

| COMPONENT | MATERIAL |
|---|---|
| Emissive Layer 52<br>d = (2–20 nm) | SiO2<br>$1.2 < \delta < 3.8$ for<br>$20\ eV < E_t < 400\ eV$ |
| Semiconducting Layer 54<br>t = 10–1000 nm | P-doped/P—O-doped Si<br>$\rho_s = 10^{-11}$–$10^{12}\ \Omega/sq$ |
| Dielectric Film 57A | $Si_xN_y$ |

-continued

| COMPONENT | MATERIAL |
|---|---|
| Thermal Oxidation Layer 57B<br>z = 2–5 um | $SiO_2 \rho_b > 10^{14}\ \Omega\cdot cm$ |
| Conductive Substrate 17 | doped Si<br>$\rho_b = 10\ \Omega\cdot cm$ |

The present invention is designed to produce an inexpensive, easily manufactured and highly reliable electron (as well as ion, photon and energetic neutrals) detector by taking advantage of the materials and techniques employed in the microelectronics industry. The potential advantages of such a device include extremely low cost; a small, rugged package; design flexibility for customization to specific applications; performance enhancement over traditional electron multipliers; and device integration not available with traditional reduced lead silicate glass (RLSG) technology.

Figure 12A:
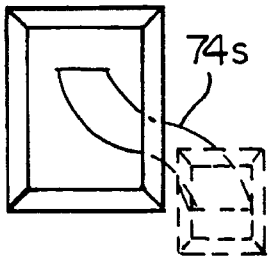
FIG. 12A is a variation of the arrangement of FIG. 6 showing a serpentine channel.
Figure 12:
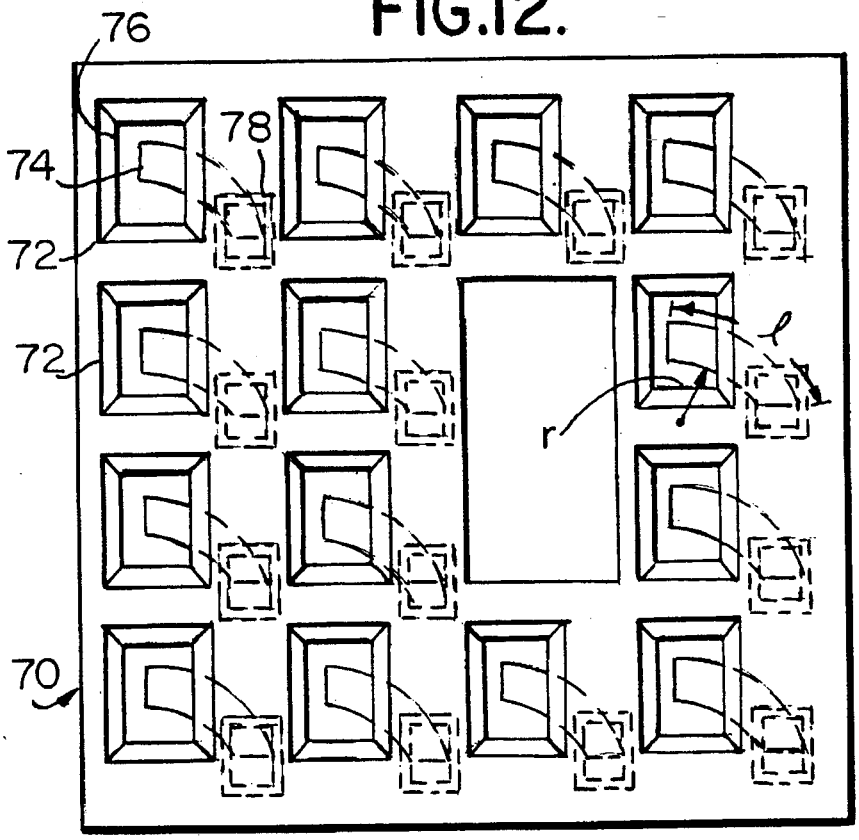
FIG. 12 is a top view of an N×N array of micromachined electron multipliers according to the present invention employing curved trenches.

Micromachining is a desirable manufacturing technique for a number of reasons. Chief among these is the potential for low-cost multipliers. The low cost results from the same batch related techniques that have allowed the microelectronics industry to produce low-cost integrated circuit chips. Micromachining allows for a high degree of dimensional precision desirable for product uniformity and quality. Micromachining also allows for access to a wide variety of mechanical configurations not easily available with traditional RLSG, such as monolithic detector arrays, 1×N or N×N, with integrated readouts. For example, FIGS. 11 and 12 illustrate two examples of arrays of electron multipliers which could be used to obtain spatial information as well as signal intensity.

Figure 11:
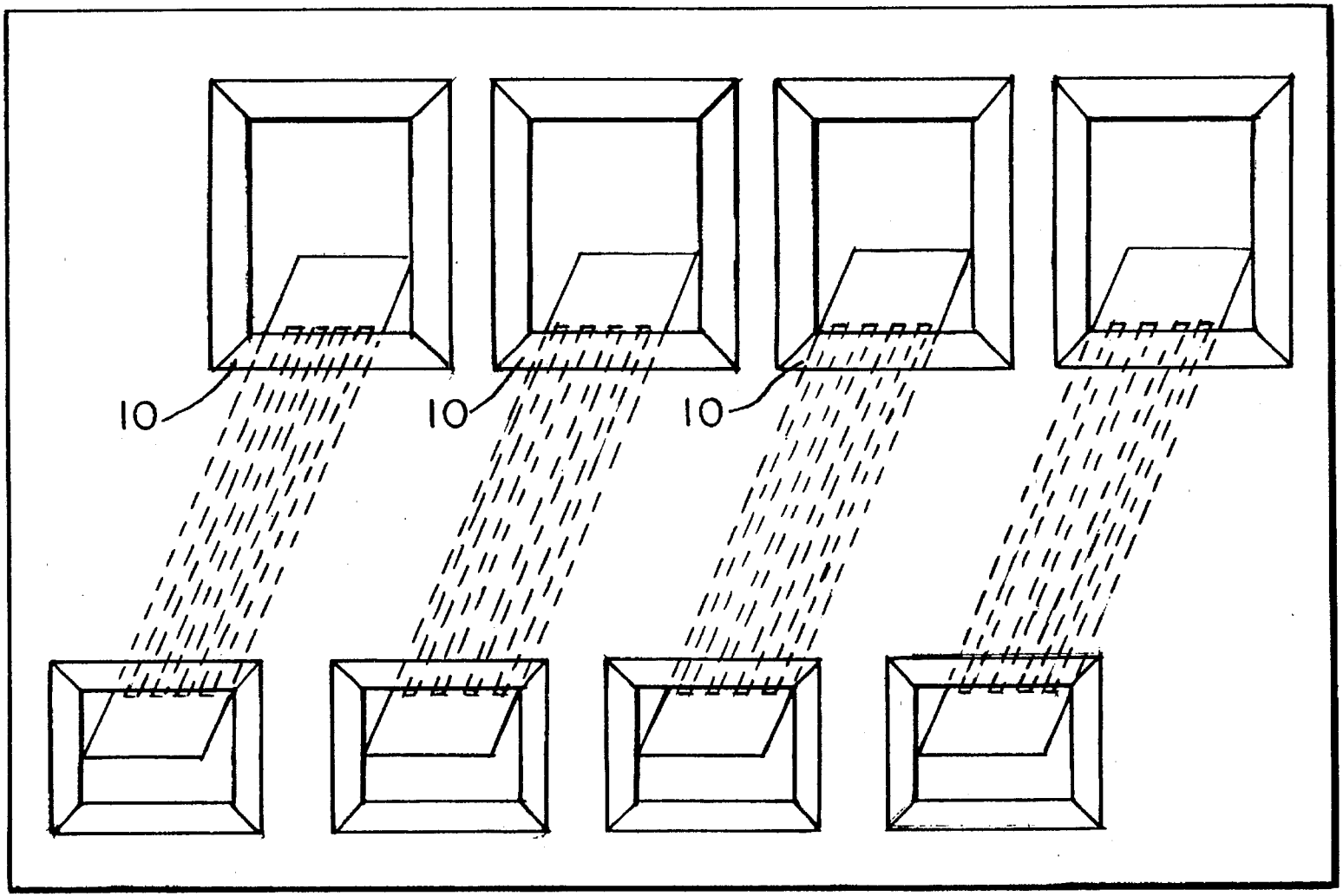
FIG. 11 is a top view of a 1×N array of micromachined electron multipliers on a common substrate.
Figure 13:
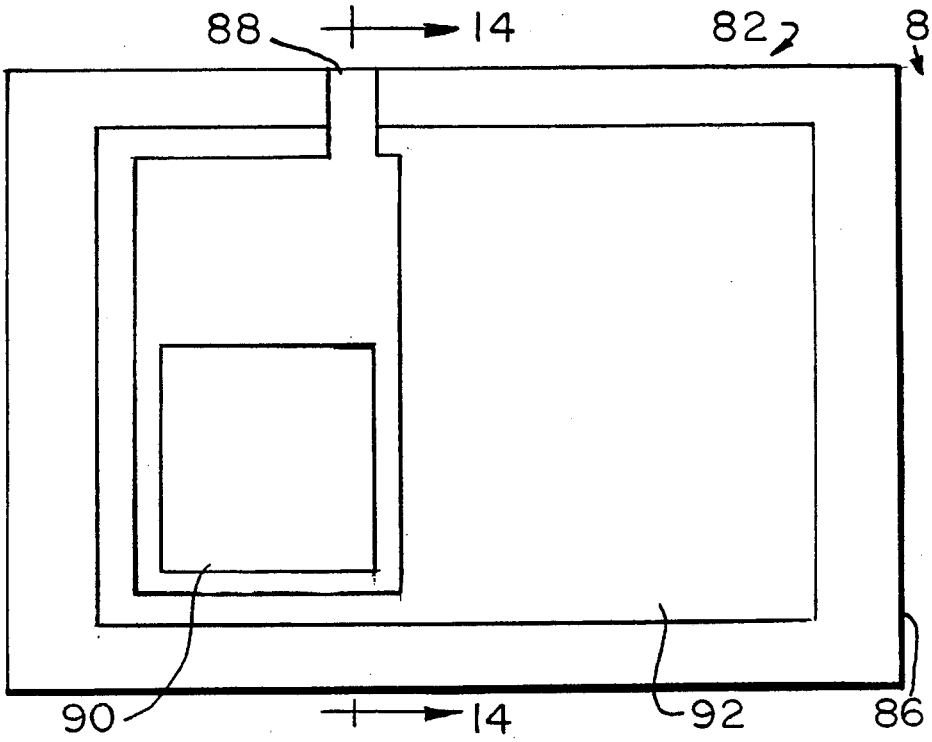
FIGS. 13 and 14 are respective top and side sectional views of a photocathode component of a photocathode employing an electron multiplier according to the present invention.
Figure 14:
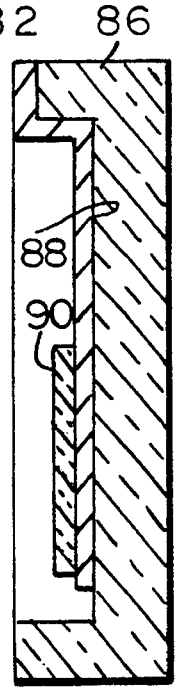
Figure 15:
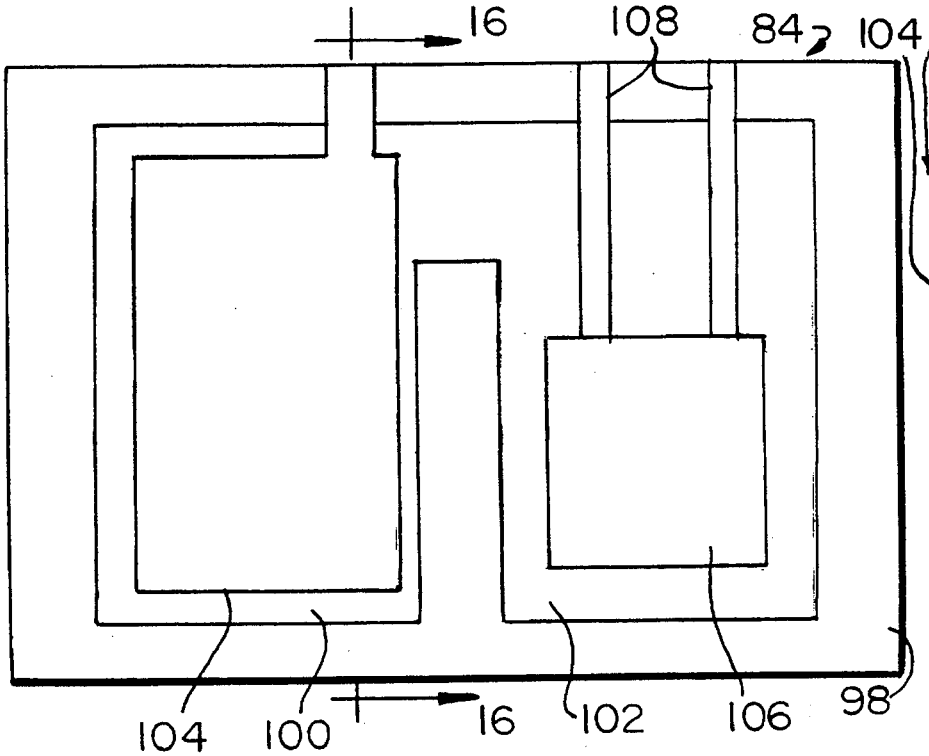
FIGS. 15 and 16 are respective top and side sectional views of an anode/getter component for a photomultiplier tube employing the electron multiplier of the present invention.
Figure 16:
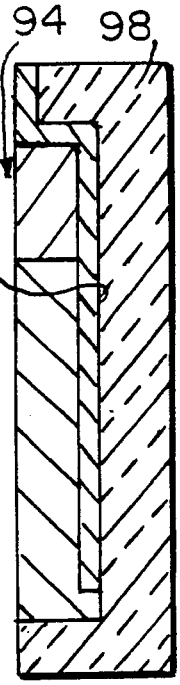

FIG. 11 is an example of a 1×N array 60 of electron multiplier devices 10 of the type shown in FIGS. 1–5 combined on a single chip. FIG. 12 is an illustration of an N×N array 70 of electron multiplier devices 72 which employ one or more curved channels 74 of radius r and an aperture arrangement similar to the arrangement of FIG. 6. The input aperture 76 is on one side of the device and the output aperture 78 is on the opposite side. FIG. 12A shows a variation of FIG. 6 with a single channel device having a serpentine channel 74S.

Silicon, in addition to its ease of fabrication, low cost, and excellent mechanical strength, provides excellent thermal conductance, a desirable quality for power dissipation. The processing techniques available for Si, along with the wide variety of materials available for use in the dynodes, provides excellent design flexibility. For example, materials with high damage thresholds under electron irradiation such as $Si_3N_4$, can be used as an emissive layer 52 (FIG. 6). Such materials also offer superior gain stability over traditionally reduced RLSG devices. Furthermore, the small size of these devices allows excellent temporal response. Additionally, RLSG is generally incompatible with high purity Si processing. Electron multipliers made with semiconductor processing techniques and materials can be readily incorporated with other Si-based electronic devices such as power supplies, amplifiers and readouts, and thus be integrated into complete detectors. Such integrated detectors would allow for a vast reduction in size over conventional discrete detectors and components. Such an arrangement is illustrated below.

Figure 17:
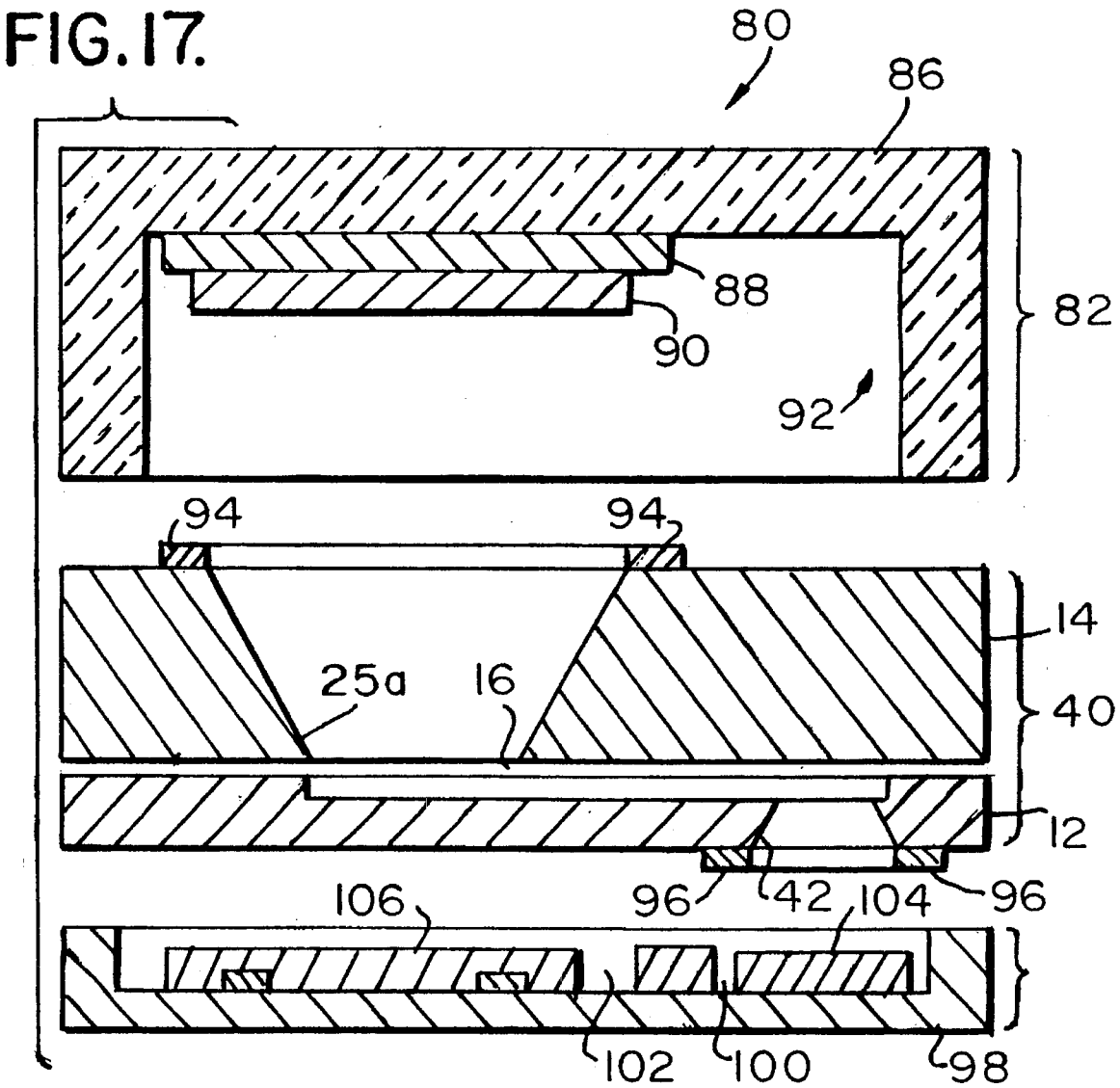
FIG. 17 is an exploded cross-sectional view of a micromachined photomultiplier tube employing the components of FIGS. 13–16 and the electron multiplier illustrated in FIG. 6.

FIGS. 13–17 illustrate an exemplary embodiment of the invention in the form of an integrated photomultiplier tube 80. FIGS. 13, 14, 15 and 16 illustrate the composites and FIG. 17 illustrates the tube 80 in exploded view. The arrangement of FIG. 17 has the potential to be low cost, simple to manufacture and rugged.

Building on the embodiment of an electron multiplier 40, shown in FIG. 6, additional components are incorporated including a photocathode component 82 (FIGS. 13 and 14) and a collector/getter component 84 (FIGS. 15 and 16) along suitable electrodes. These components may be composed in part of a borosilicate glass having a thermal expansion close to that of Si.

The photocathode component 82 comprises a glass substrate 86 transparent to light or other radiation, an electrode 88 on an interior surface of the glass 86 also likewise transparent and a photocathode 90 on the electrode 88. The substrate 86 may have a recess 92 forming an input chamber.

The electron multiplier 40 such as shown in FIG. 6 has respective input and output electrodes 94 and 96 respectively located adjacent the input aperture 25A and the output aperture 42.

The anode getter component 82 comprises a substrate 98 which may have one or more recesses 100, 102 into which an anode 104, a getter 106 and getter anode 108 are respectively located.

The various electrode patterns are illustrated in FIGS. 13–16. In the arrangement illustrated, the electrodes 88, 104 and 108 are taken out to the edge of the device, as shown. The device is evacuated and sealed.

A photomultiplier tube generally requires a vacuum envelope in which to operate. By using the electron multiplier 40 itself as the envelope, the processing of the tube is greatly simplified. Assembling the three components 40, 82 and 84 and forming the vacuum is simplified by the materials (Si and borosilicate glass) and the use of a known field-assisted thermal bonding technique. When sealed together, the three components together create a self-contained vacuum environment where normally a glass envelope would be utilized. The vacuum inside the device 80 may be enhanced and/or maintained with the getter. In the exemplary embodiment, the getter 108 may be Titanium (Ti) acting as a sublimation pump.

While there have been described what are at present considered to be the preferred embodiments of the present invention, it will be apparent to those skilled in the art that various changes and modifications may be made therein without departing from the invention, and it is intended in the appended claims to cover such changes and modifications as fall within the spirit and scope of the invention.

What is claimed is:

1. An electron multiplier comprising:

a substrate with at least one channel having opposite ends;

a channel cover disposed over the substrate for enclosing the at least one channel and being bonded thereto, said cover having at least one aperture formed therein located in communication with an end of said at least one channel, and one of the substrate and the cover having an aperture formed therein for communication with the other end of the at least one channel; and a thin-film dynode formed in the enclosed channel including an electron emissive portion overlying a current carrying portion overlying an isolation layer for isolating the emissive and current carrying portions of the dynode from the substrate and channel cover.

2. The electron multiplier of claim 1 wherein the substrate is electrically conductive.

3. The electron multiplier of claim 2 wherein the substrate comprises Si.

4. The electron multiplier of claim 1 wherein the cover has two apertures.

5. The electron multiplier of claim 1 wherein the substrate has an aperture in registration with an end of at the least one channel.

6. The electron multiplier of claim 1 wherein the at least one channel is formed with leg portions interconnected at an angle.

7. The electron multiplier of claim 6 wherein the angle is in a range of about 120° and about 160°.

8. The electron multiplier of claim 7 wherein d=w.

9. The electron multiplier of claim 1 wherein the channel has a length dimension l, a depth dimension d and a width dimension w and wherein l/d is in a range of about 10:1 and about 100:1.

10. The electron multiplier of claim 9 wherein the depth d of the channel is in a range of about 4 and about 100 micrometers.

11. The electron multiplier of claim 9 wherein the channel has a width w in a range of about 4 μm and about 1000 μm.

12. The electron multiplier of claim 1 wherein the channel is curved.

13. The electron multiplier of claim 12 wherein the curved channel has a length l and a radius of curvature r and l/r is in a range of about 1 and about 6.

14. The electron multiplier of claim 12 wherein the channel is serpentine.

15. The electron multiplier of claim 1 wherein the substrate is formed with a slot transverse to the at least one channel dividing the substrate into multiple stages.

16. The electron multiplier of claim 1 wherein the channel has an inlet portion and an outlet portion formed adjacent the corresponding ends and being in communication with the inlet and outlet aperture.

17. The electron multiplier of claim 1 wherein the at least one channel is arranged in a 1×N array of electron multipliers.

18. The electron multiplier of claim 1 wherein the array is N×N electron multipliers.

19. The electron multiplier of claim 1 wherein the isolation layer comprises a film of $SiO_2$.

20. The electron multiplier of claim 19 wherein the layer has a thickness in a range of approximately 2 μm to approximately 5 μm.

21. The electron multiplier of claim 19 wherein the film further comprises an overlying layer of $Si_xN_y$.

22. The electron multiplier of claim 1 wherein the semiconductor film comprises n type Si,

23. The electron multiplier of claim 22 wherein the n type Si includes a dopant selected from the group comprising P and As.

24. The electron multiplier of claim 22 further comprising the addition of dopants selected from the group comprising O and N to stabilize the electrical properties of the n type Si during subsequent thermal processing.

25. The electron multiplier of claim 22 wherein the dopants are present in the current carrying portion in amounts sufficient to obtain a resistance across said at least one channel in a range of about $10^6$ and $10^9$ ohms.

26. The electron multiplier of claim 1 wherein the semiconductor film comprises p type Si.

27. The electron multiplier of claim 26 wherein the p type Si includes a dopant selected from the group comprising B and Al.

28. The electron multiplier of claim 1 wherein the emissive film comprises a material selected from the group comprising $SiO_2$, $Si_3N_4$, $Al_2O_3$, AlN, MgO and C (diamond).

29. The electron multiplier of claim 1 wherein the at least one aperture in the cover is in registration with the end of the channel.

30. The electron multiplier of claim 1 wherein the aperture in one of the cover and substrate is in registration with the other end of the channel.

31. A photomultiplier comprising a cover portion transparent to radiation of a selected wavelength, said cover condition formed with an electrode portion transparent to said radiation deposed on one side thereof and a photocathode overlying the electrode portion;

an output substrate formed with an anode overlying the output substrate; and an electron multiplier comprising a substrate with at least one channel having opposite ends;

a channel cover disposed over the substrate for enclosing the at least one channel and being bonded thereto, said cover having an aperture formed therein located in communication with an end of said at least one channel and the photocathode;

the substrate having an aperture formed therein for communication with the other end of the at least one channel and being in registration with the anode; and a thin-film dynode formed in the enclosed channel including an electron emissive portion overlying a current carrying portion overlying an isolation layer for isolating the emissive and current carrying portions of the dynode from the substrate and channel covers.

32. The photomultiplier tube of claim 31 further comprising a getter disposed on the substrate adjacent the anode.

33. The electron multiplier of claim 31 wherein the apertures are in registration with opposite ends of the channel.

* * * * *